US006152244A

United States Patent [19]

Rokbi

[11] Patent Number: 6,152,244

[45] **Date of Patent: *Nov. 28, 2000**

[54] DRILLING APPARATUS MOUNTED ON WHEELS, WITH ARTICULATED CHASSIS

[75] Inventor: Chouaib Rokbi, Saint Fons, France

[73] Assignee: Sandvik Tamrock Secoma SA, Meyzieu, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/111,854

[22] Filed: Jul. 8, 1998

[30] Foreign Application Priority Data

Jul. 11, 1997 [FR] France ..... 97 09112

[51] Int. Cl.[7] ..... E21B 07/02

[52] U.S. Cl. ..... 173/184; 173/46

[58] Field of Search ..... 173/184–186, 173/192, 27, 28, 146; 180/235; 248/647, 648

[56] References Cited

U.S. PATENT DOCUMENTS

| | | | |
|---|---|---|---|
| 2,827,715 | 3/1958 | Wagner | 180/235 |
| 3,157,239 | 11/1964 | Bernotas | 180/235 |
| 3,237,790 | 3/1966 | Kampert et al. | 180/235 |
| 3,435,908 | 4/1969 | Sunderlin et al. | 180/235 |
| 3,744,574 | 7/1973 | Carley | 173/27 |
| 3,811,699 | 5/1974 | Casey | 180/235 |
| 3,823,902 | 7/1974 | Bumueller | 173/28 |
| 3,921,836 | 11/1975 | Wyslouch et al. | 180/235 |
| 4,072,354 | 2/1978 | Holmes | 173/28 |
| 4,363,519 | 12/1982 | Howard | 173/186 |

FOREIGN PATENT DOCUMENTS

| | | |
|---|---|---|
| 0 203 907 | 12/1986 | European Pat. Off. . |
| 2 230 807 | 10/1990 | United Kingdom . |

*Primary Examiner*—Peter Vo
*Assistant Examiner*—Jim Calve
*Attorney, Agent, or Firm*—Herbert Dubno

[57] ABSTRACT

A mobile drilling apparatus has a front chassis with two wheels, and a rear chassis with two wheels, which are joined together by an intermediate articulation about a vertical axis. To improve the lateral stability when turning, the front chassis is extended backward behind the intermediate axis of articulation and above a portion of the rear chassis. The front chassis thus extends support, in addition to the drilling arm or arms and the driving and work station of some of the electrical and/or hydraulic equipment of the apparatus. In a converse arrangement, the rear chassis is extended forward, in front of the axis of articulation and over a portion of the front chassis.

3 Claims, 5 Drawing Sheets

DRILLING APPARATUS MOUNTED ON WHEELS, WITH ARTICULATED CHASSIS

SPECIFICATION

FIELD OF THE INVENTION

The present invention relates to mobile drilling apparatus, mounted on wheels, intended in particular for performing underground work. This invention relates more specifically to the design of the "carrying" or "vehicle" part of the drilling apparatus, which is of the type having an articulated chassis.

BACKGROUND OF THE INVENTION

Drilling apparatus mounted on wheels, the "carrying" or "vehicle" part of which is made up of a front chassis with two wheels and a rear chassis with two other wheels, the front chassis and the rear chassis being joined together by an intermediate articulation about an approximately vertical axis is already known. This articulation allows the apparatus to be steered, particularly when turning, the angle formed between the front and rear parts determining the radius of the turn.

In present-day embodiments of this kind, the front chassis is usually situated wholly in front of the axis of articulation to the rear chassis; this front chassis carries one or two drilling arms. The rear chassis is situated wholly behind the intermediate axis of articulation and, for its part, supports all of the a mechanical, electrical, hydraulic and other equipment of the drilling apparatus, in particular: oil reservoir, fuel tank, combustion engine, electric motors, water pump, compressor, electric cabinets, electric cable winder, etc. Depending on the embodiment, the driving and work station of the apparatus, where the operator is, may be carried by the front chassis or by the rear chassis. Examples of such drilling apparatus mounted on wheels, with an articulated chassis, are given in documents EP-A-0 203 907 and GB-A-2 230 807.

The current design of this apparatus has drawbacks, particularly when the apparatus is turning, the front chassis and the rear chassis then forming an angle which is permitted by the intermediate articulation. Because of its mass and its position, all the equipment carried by the rear chassis actually tends in such a situation to unbalance the apparatus, in particular reducing its lateral stability. To avoid destability of the apparatus, the angle of turning must remain relatively restricted. What is more, the current design entails passing numerous hydraulic lines through the intermediate articulation.

There is also known, from document U.S. Pat. No. 3,823,902, a drilling apparatus mounted on wheels, with an articulated chassis, in which the rear chassis is extended over the front chassis, by a part of the platform kind which supports the drilling arm or arms, and the driving and work station, produced in the form of a pivoting cab. In this embodiment, the front chassis carries only the two front wheels of the apparatus, and is thus restricted to a steering assembly. All the equipment, including the drilling arm or arms are, in this instance, carried by the rear chassis alone. This is therefore apparatus in which the distribution of equipment and of mass between the front and rear chassis is very unbalanced.

The configuration of such apparatus means that when this apparatus is turning, its front support points (points of contact of the front wheels with the ground) are shifted toward the inside of the turn, without the center of gravity of the apparatus shifting significantly. This leads to a risk of the apparatus toppling over toward the outside of the turn, and the instability of the apparatus is, in this instance, aggravated by the fact that its particular structure means that its center of gravity is higher up because the drilling arm or arms and the cab have to be high enough above the front wheels that they can pivot.

Thus, the apparatus according to document U.S. Pat. No. 3,823,902 also has a great deal of lateral instability when turning. What is more, the fact that the drilling arm or arms of this apparatus are carried by the rear chassis makes the apparatus very bulky when turning, because the arm or arms do not follow the direction taken by the front chassis, this forcing an additional movement of retracting the arm or arms.

OBJECT OF THE INVENTION

The present invention sets out to avoid all the aforementioned drawbacks by providing drilling apparatus mounted on wheels, of the type in question here, which has better lateral stability when turning, and a smaller bulk, and which also makes it possible to reduce the number of hydraulic lines passing through the articulation.

SUMMARY OF THE INVENTION

To this end, the subject of the invention is essentially a drilling apparatus mounted on wheels, the "carrying" or "vehicle" part of which is made up of a front chassis with two wheels and a rear chassis with two wheels, the front chassis and the rear chassis being joined together by an intermediate articulation about an approximately vertical axis, the front chassis carrying at least one drilling arm, and the apparatus comprising a driving and work station, wherein, in order to increase the lateral stability of the apparatus when turning, the front chassis is extended backward, behind the intermediate axis of articulation and above a portion of the rear chassis, or conversely the rear chassis is extended forward in front of the intermediate axis of articulation and above a portion of the front chassis.

In one embodiment of the invention, the front chassis, extended backward, supports, in addition to the drilling arm or arms and the driving and work station of the apparatus, some of the equipment, especially electrical and/or hydraulic equipment, of the apparatus. In this case, the front chassis is preferably extended backward above a portion of the rear chassis, as far as over the wheels of this rear chassis. The front chassis, thus extended backward, may, in particular, support, by way of equipment, the oil reservoir and the electric motors of the apparatus.

Transferring some of the equipment to the front chassis, extended backward beyond the intermediate axis of articulation, allows some of the mass of this equipment to be shifted forward. Above all, when the apparatus is turning, some of the mass is transferred outward (with reference to the center of the path taken by the apparatus), and this balances the apparatus and increases its lateral stability, by a "counterweight" effect which brings the center of gravity of the apparatus into an area favorable to its stability.

It will be noted that the configuration of the drilling apparatus that is the subject of the invention makes it possible to reduce its height, and this contributes to the stability of the apparatus and also makes it easier for it to run in places of restricted height (mine galleries).

It can also be noted that, for the same stability as conventional articulated apparatus, it is possible, by virtue of the invention, to reduce the width of the apparatus and/or increase the turn angle at no risk, thus affording better maneuverability.

Furthermore, transferring some of the equipment onto the rear extension of the front chassis, itself overhanging a portion of the rear chassis, makes it possible to produce a particularly compact drilling apparatus.

Furthermore, through a judicious choice of the equipment placed on the front chassis, the invention makes it possible to reduce the number of hydraulic lines that pass through the articulation between the front chassis and the rear chassis, thus simplifying the construction and eliminating certain risks of incidents.

Furthermore, as the drilling arm or arms are mounted on the front chassis of the apparatus, they follow the direction taken by this front chassis when the apparatus performs a turn, and this reduces the turn radius and makes any retraction of the drilling arm or arms unnecessary.

The previously defined embodiment is more particularly advantageous in the case of apparatus equipped with two drilling arms, which together represent a fairly significant mass concentrated on the front part of the apparatus.

When the mass of the front part is lower, which is in particular the case of apparatus which has just one drilling arm, the benefit is derived from counterbalancing the most heavily-loaded part, therefore the rear part, still in order to obtain the desired stability. In this case, according to another embodiment of the invention, it is the rear chassis of the apparatus which is extended forward, in front of the intermediate axis of articulation and above a portion of the front chassis. As a preference, the rear chassis then supports the driving and work station of the apparatus, and this station forms that part of the is rear chassis which extends over a portion of the front chassis. This solution, which is the opposite to the previous one, also makes it possible to produce compact drilling apparatus of a reasonable height, the lateral stability of which is improved.

In this respect, it will be noted that, as the number of hydraulic hoses is fewer in the case of apparatus with just one drilling arm, it then becomes possible and easy to pass the bundle of hoses through the intermediate articulation without increasing the height of the apparatus, and therefore while at the same time maintaining good stability.

BRIEF DESCRIPTION OF THE DRAWINGS

The invention will be better understood with the aid of the description which follows, with reference to the appended diagrammatic drawing which depicts, by way of examples, two embodiments of this drilling apparatus mounted on wheels, with an articulated chassis.

SPECIFIC DESCRIPTION

Figure 1:
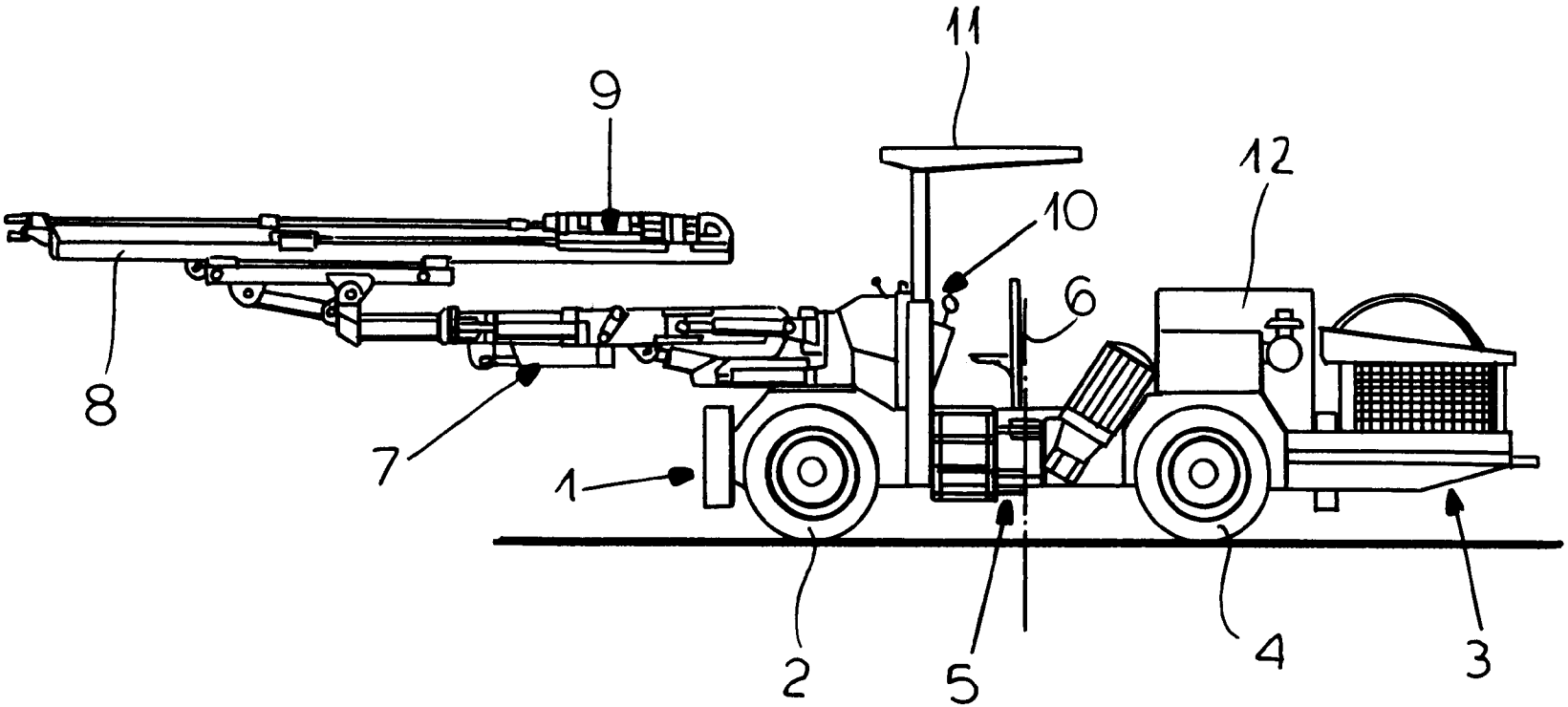
FIG.1 PRIOR ART
FIG. 1 is a side view of drilling apparatus of this type, of a conventional design.

FIG. 1 shows, as a reminder of the state of the art, drilling apparatus with an articulated chassis, of conventional design. The "carrying" or "vehicle" part of the apparatus is made up of a front chassis 1 with two wheels 2, and a rear chassis 3 with two wheels 4. The front chassis 1 is connected to the rear chassis 3 by an intermediate articulation 5 which defines a vertical axis of articulation 6. The front chassis 1 carries one or two drilling arms 7, each equipped with a slideway 8 along which a drilling device 9 of the hydraulic hammer drill kind can move. The front chassis 1 also carries the driving and work station 10 of the apparatus, surmounted by a protective roof 11. As to the rear chassis 3, this supports all of the mechanical, electrical and hydraulic equipment of the apparatus, most of them grouped together under a hood, at 12.

Figure 2:
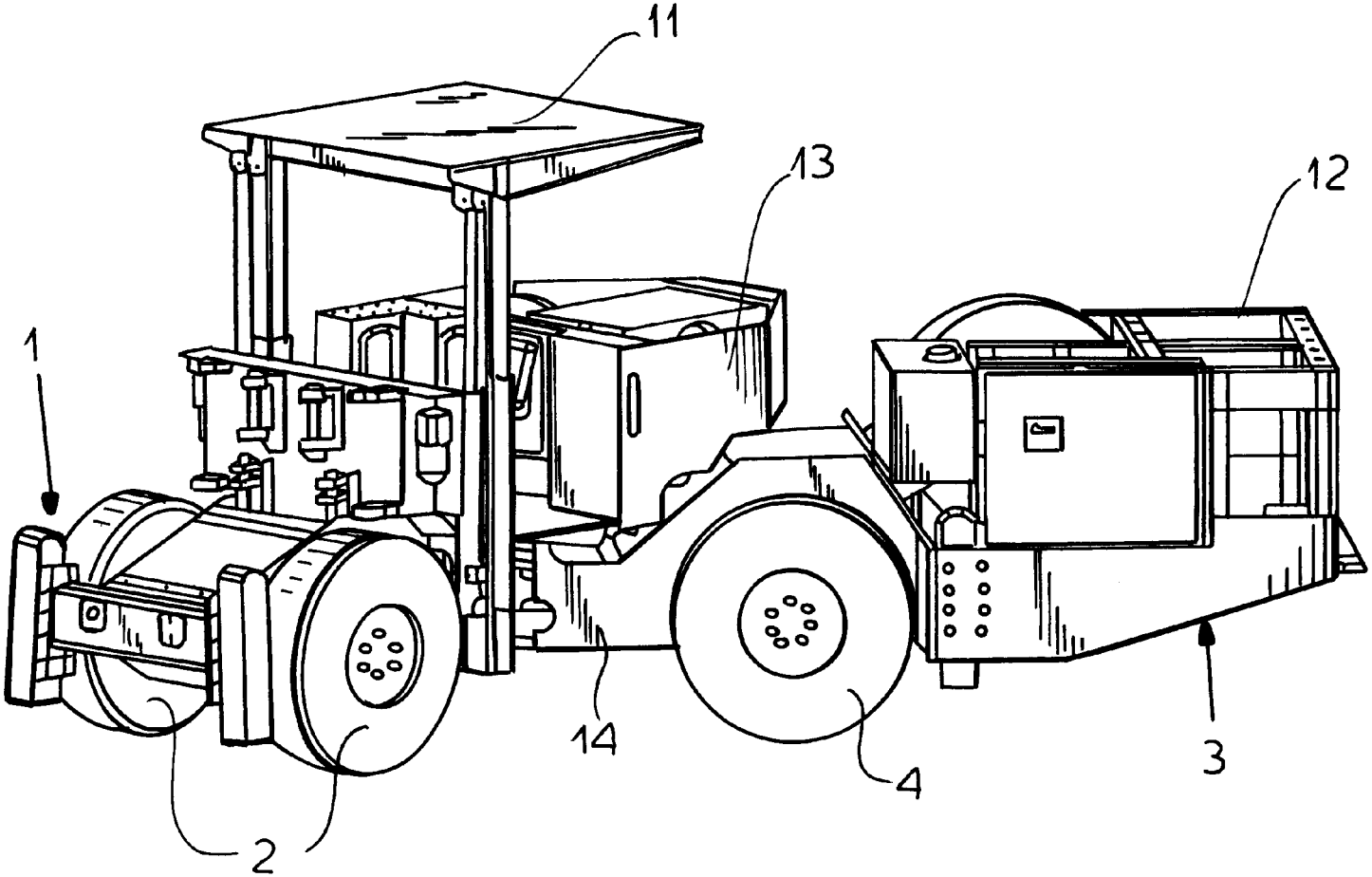
FIG. 2 is a view in perspective of drilling apparatus in accordance with the present invention, in a first embodiment.
Figure 3:
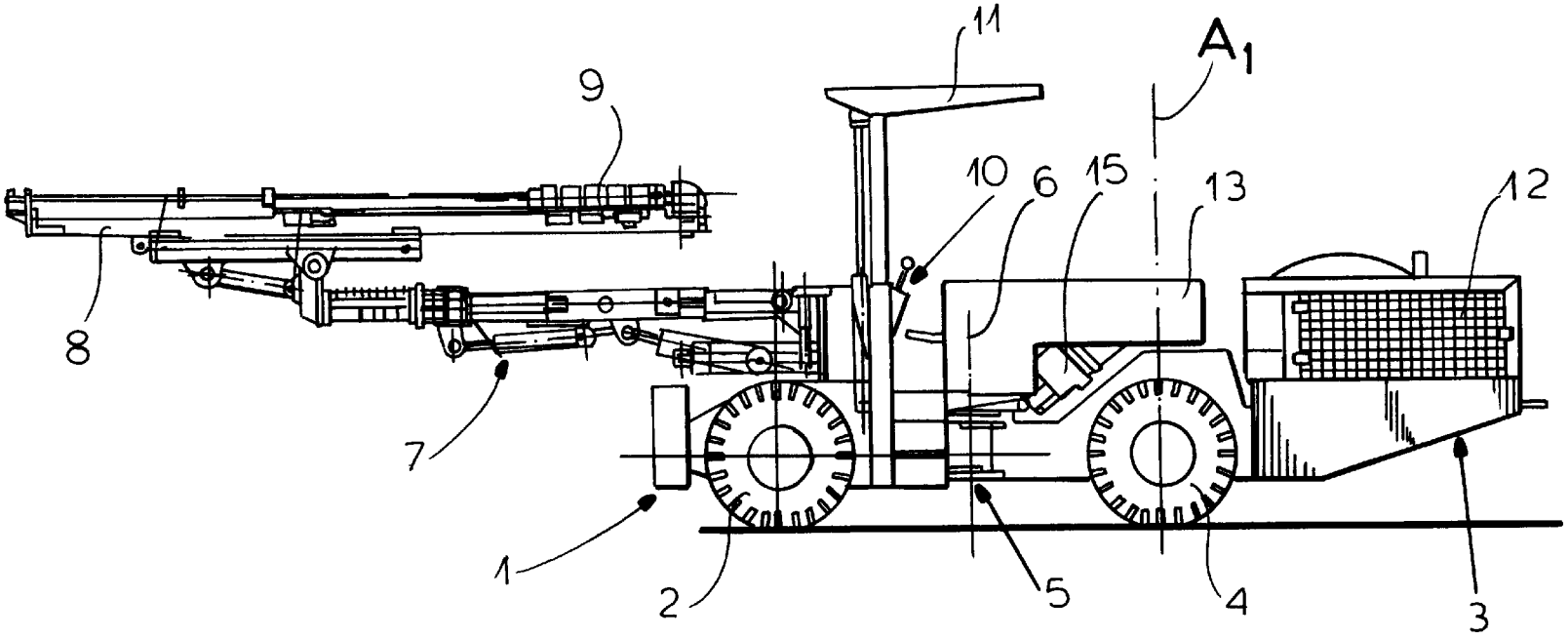
FIG. 3 is a side view of the drilling apparatus of FIG. 2.
Figure 4:
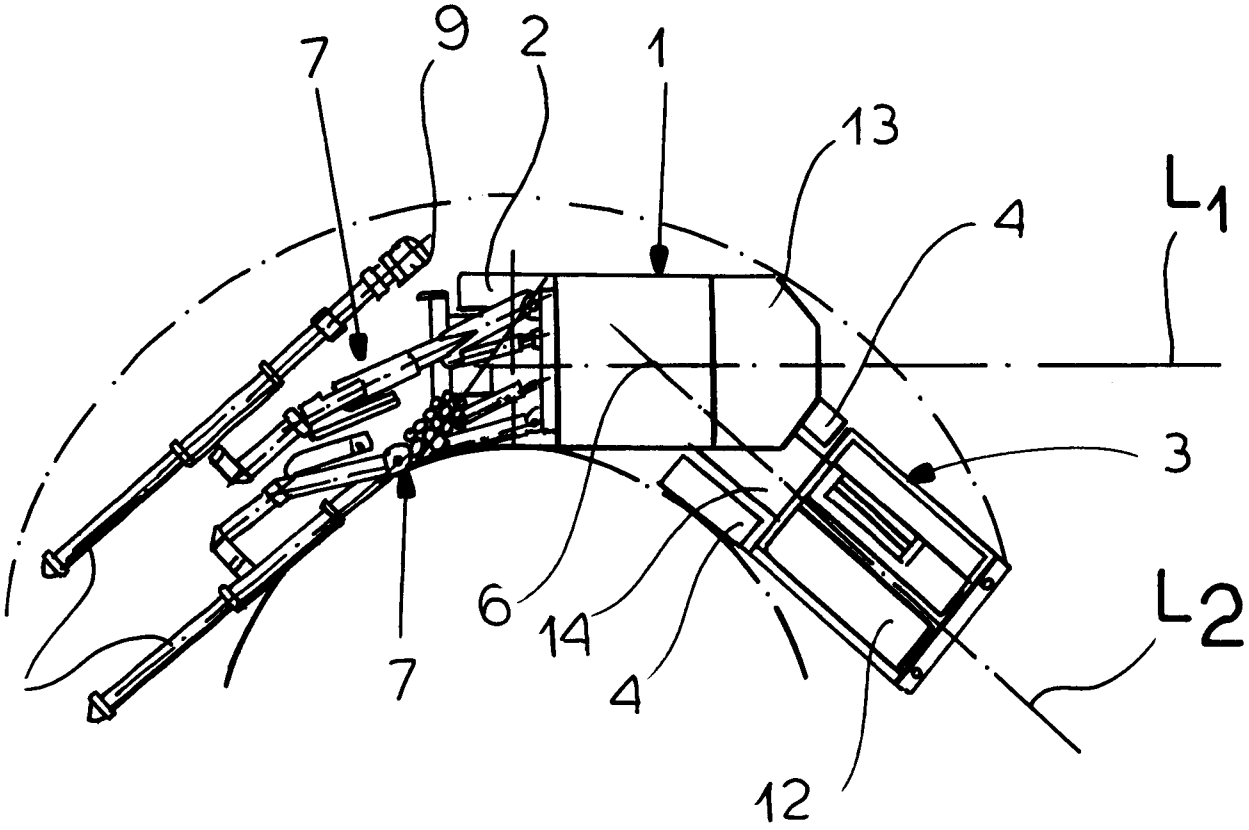
FIG. 4 is a plan view from above of the drilling apparatus according to the invention, depicted as it is turning.

FIGS. 2 to 4 depict a first embodiment of drilling apparatus with articulated chassis in accordance with the invention, using the same numerical references as in FIG. 1, this apparatus being equipped with two drilling arms 7 which, to make the drawing clearer, have not been shown in the perspective view that is FIG. 2.

As before, the front chassis 1 with two wheels 2 carries the drilling arms 7 and the driving station 10 surmounted by the protective roof 11. According to the invention, the front chassis 1 is extended backward, behind the axis 6 of articulation to the rear chassis 3, by a part 13 which supports some electrical and hydraulic equipment of the apparatus. The part 13, extending the front chassis 1 backward, extends over the front portion 14 of the rear chassis 3, as far as over the two wheels 4 of this rear chassis 3 and rearwardly beyond a vertical axis A1 extending through an axis of rotation of said rear chassis wheels 4.

The equipment mounted in the part 13 extending the front chassis 1 backward may, in particular, include the oil reservoir and the electric motors, as can be seen at 15. The other usual equipment is still supported, at 12, by the rear chassis 3.

As illustrated by FIG. 4, the position and mass of the part 13 that extends the front chassis 1 backward, contribute to the lateral stability of the drilling apparatus, when it is turning, particularly in the event of a tight turn corresponding to a significant angle between the longitudinal axis (L1) of the front chassis 1 and the longitudinal axis (L2) of the rear chassis 3.

Figure 5:
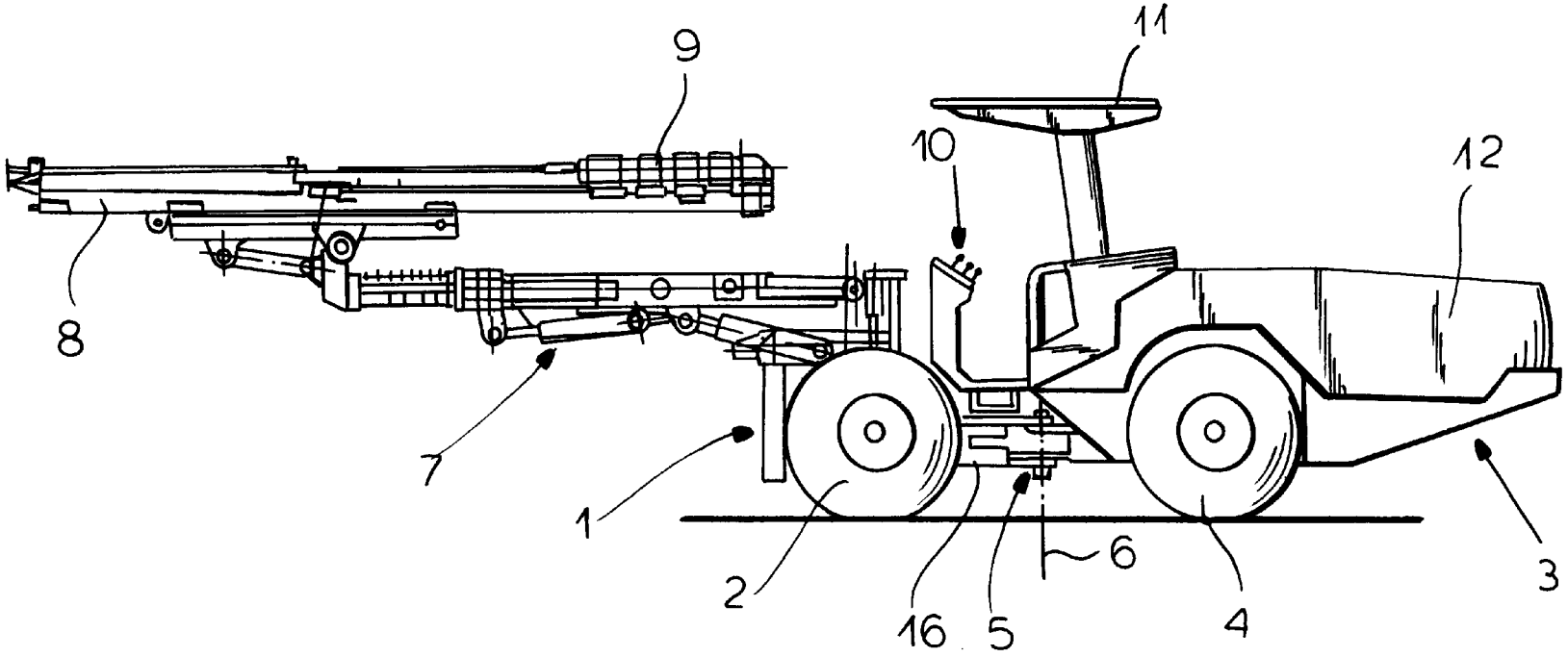
FIG. 5 is a side view of drilling apparatus in accordance with the present invention, in a second embodiment.

FIG. 5 depicts a second embodiment of drilling apparatus with articulated chassis in accordance with the invention, this apparatus in particular being equipped with just one drilling arm 7.

The front chassis 1 with two wheels 2 carries the drilling arm 7. The rear chassis 3 with two wheels 4 carries the mechanical, electrical and hydraulic equipment of the apparatus, grouped together under a hood 12. According to the invention, the rear chassis 3 is extended forward, in front of the axis 6 of articulation to the front chassis 1, by a certain part which extends over the rear portion 16 of the front chassis 1, as far as above the two wheels 2 of this front chassis 1.

More specifically, the part which thus extends the rear chassis 3 forward consists of a portion of the driving station 10 of the apparatus, here secured to the rear chassis 3. It will be noted that the protective roof 11, secured to the rear chassis 3, is also extended forward of the axis of articulation 6.

It would not be departing from the scope of the invention if the detailed shapes of the front and rear chassis were to be modified, or if the equipment were to be distributed between the front and rear chassis in a different way, provided that the principle of a front chassis extended backward, behind its axis of articulation to the rear chassis, or conversely of a rear chassis extended forward, in front of its axis of articulation to the front chassis, were kept.

What is claimed is:

1. A wheeled drilling apparatus comprising:

a front chassis having a longitudinal axis, a pair of wheels;

at least one drilling arm and an operator's station mounted on said front chassis, said operator's station being located rearwardly of said pair of wheels with respect to a forward direction of travel of said apparatus along the ground;

a rear chassis disposed rearwardly of said front chassis in the direction of travel and having a pair of wheels;

drive equipment for the drilling apparatus mounted on said rear chassis rearwardly of said pair of rear wheels;

means forming an articulation between said front chassis and said rear chassis with a vertical axis enabling turning of the apparatus during travel thereof with formation of a variable angle between longitudinal axes of said front chassis and said rear chassis about said vertical axis; and to stabilize the apparatus in turns, an extension formed on said front chassis behind said operator's station and extending rearwardly of said operator's station above said articulation and carrying an oil reservoir and electric motors of the apparatus, said extension extending rearwardly with respect to said direction from said front chassis to a location above and rearwardly beyond a vertical axis extending through an axis of rotation of said rear chassis wheels when the longitudinal axes of said front and rear chassis are aligned.

2. The wheeled drilling apparatus defined in claim 1 wherein said operator station includes a protective roof.

3. The wheeled drilling apparatus defined in claim 2 wherein said drilling arm has a slideway carrying a hydraulic hammer drill device.

* * * * *